US007259117B2

(12) United States Patent
Mater et al.

(10) Patent No.: US 7,259,117 B2
(45) Date of Patent: Aug. 21, 2007

(54) NONWOVEN HIGHLOFT FLAME BARRIER

(76) Inventors: Dennis L. Mater, 3022 Bretton La., Glen Allen, VA (US) 23060; Alan C. Handermann, 11 Laurel Summit Dr., Asheville, NC (US) 28803

( * ) Notice: Subject to any disclaimer, the term of this patent is extended or adjusted under 35 U.S.C. 154(b) by 0 days.

(21) Appl. No.: 10/474,395

(22) PCT Filed: Sep. 11, 2002

(86) PCT No.: PCT/US02/28743

§ 371 (c)(1),
(2), (4) Date: May 10, 2004

(87) PCT Pub. No.: WO03/023102

PCT Pub. Date: Mar. 20, 2003

(65) Prior Publication Data

US 2004/0198125 A1 Oct. 7, 2004

Related U.S. Application Data

(60) Provisional application No. 60/318,335, filed on Sep. 12, 2001.

(51) Int. Cl.

| | |
|---|---|
| ***D04H 1/00*** | (2006.01) |
| ***D04H 13/00*** | (2006.01) |
| ***D04H 3/00*** | (2006.01) |
| ***D04H 5/00*** | (2006.01) |

(52) U.S. Cl. ..... 442/414

(58) Field of Classification Search ..... 442/414
See application file for complete search history.

(56) References Cited

U.S. PATENT DOCUMENTS

| | | | | |
|---|---|---|---|---|
| 4,726,987 | A | 2/1988 | Trask et al. | 428/282 |
| 4,863,797 | A | 9/1989 | Ichibori et al. | 428/359 |
| 4,865,906 | A | 9/1989 | Smith, Jr. | 428/224 |
| 4,950,540 | A | 8/1990 | McCullough, Jr. et al. | 428/369 |
| 4,970,111 | A | 11/1990 | Smith, Jr. | 428/283 |
| 5,149,582 | A | 9/1992 | LaMarca, II et al. | 428/234 |
| 5,169,582 | A | 12/1992 | Illing | 264/141 |
| 5,208,105 | A | 5/1993 | Ichibori et al. | 428/373 |
| 5,348,796 | A | 9/1994 | Ichibori et al. | 428/224 |
| 5,393,601 | A * | 2/1995 | Heinrich et al. | 442/411 |
| 5,503,915 | A | 4/1996 | Ichibori et al. | 428/224 |
| 5,503,916 | A | 4/1996 | Ichibori et al. | 428/224 |
| 5,506,042 | A | 4/1996 | Ichibori et al. | 428/224 |
| 5,534,325 | A | 7/1996 | Jörder et al. | 428/102 |
| 5,585,161 | A | 12/1996 | Difloe et al. | 428/109 |
| 5,645,926 | A * | 7/1997 | Horrocks et al. | 442/234 |
| 5,849,648 | A * | 12/1998 | Kent et al. | 442/414 |
| 5,968,855 | A | 10/1999 | Perdelwitz, Jr. et al. | 442/341 |
| 6,129,879 | A | 10/2000 | Bersted et al. | 264/211.14 |
| 6,287,686 | B1 | 9/2001 | Huang et al. | 428/362 |
| 6,287,690 | B1 | 9/2001 | Land | 428/370 |
| 6,297,178 | B1 | 10/2001 | Berbner et al. | 442/302 |
| 6,358,608 | B1 | 3/2002 | Hanyon et al. | 428/362 |
| 6,489,256 | B1 | 12/2002 | Kent et al. | 442/302 |
| 2003/0054717 | A1 | 3/2003 | Ahluwalia | 442/136 |
| 2003/0176125 | A1 | 9/2003 | Ahluwalia | 442/59 |

FOREIGN PATENT DOCUMENTS

| | | |
|---|---|---|
| EP | 0355193 | 2/1990 |
| EP | 0622332 | 11/1994 |
| GB | 2245606 | 1/1992 |
| JP | 52144470 | 12/1977 |
| KR | 2002074868 A * | 10/2002 |
| WO | WO 01/53578 | 7/2001 |

OTHER PUBLICATIONS

A Guide to Fibers for Nonwovens, Nonwovens Industry, Jun. 1987, pp. 26-45.*

Bureau of Home Furnishing and Thermal Insulation website, date unknown, available as of filing date, 2 pages.

BCC website, Halogen and Nonhalogen Flame Rectardancy, The Thirteenth Annual BCC Conference on Flame Retardancy, Jun. 2-5, 2002, 3 pages.

Porter, K., "Nonwoven Textile Fabrics: Spunbonded," in *Encyclopedia of Chemical Technology*, 3rd Ed., vol. 16, Jul. 1984, New York, pp. 72-104.

Drelich, Arthur, "Nonwoven Textile Fabrics: Staple Fibers," in *Encyclopedia of Chemical Technology*, 3rd Ed., vol. 16, Jul. 1984, John Wiley & Sons, New York, pp. 104-124.

(Continued)

*Primary Examiner*—Norca L. Torres Velazquez
(74) *Attorney, Agent, or Firm*—Womble Carlyle Sandridge & Rice, PLLC; C. Robert Rhodes

(57) ABSTRACT

The invention relates to a nonwoven highloft flame barrier well suited for use in mattress, upholstered furniture and other end use applications where a highloft nonwoven material is desired for flame barrier purposes. A preferred nonwoven highloft flame barrier of the invention comprises a blend of fibers, that are inherently fire resistant and essentially nonshrinking to direct flame, with melamine fibers being preferred either alone or in conjunction with, for example, viscose rayon based fibers, fibers extruded from polymers made with halogenated monomers and preferably low-melt binder fibers, which are thermally activated in a highloft manufacturing process to provide low bulk density, resiliency and insulation properties in the end use application. The preferred fiber blends are designed to withstand extended periods of time exposed to open flame with minimal shrinkage of the char barrier; thereby preventing a flames from "breaking through" the char barrier and igniting underlying materials. Other component fibers can also, optionally, be included such as: natural fibers, to improve product economics in the end use application. The highloft flame barrier of this invention also allows for the manufacture of open flame resistant composite articles, while also permitting the continued use of conventional non-flame retardant dress cover fabrics, conventional non-flame retardant fiberfills and conventional non-flame retardant polyurethane foams.

56 Claims, No Drawings

OTHER PUBLICATIONS

Säteri Oy website, 10 pages, date unknown, available as of filing date.

State of California, Department of Consumer Affairs, Bureau of Home Furnishings and Thermal Insulation, "Flammability Test Procedure for Mattresses for Use in Public Buildings," Technical Bulletin 129, Oct. 1992, pp. 1-31.

State of California, Dept. of Consumer Affairs, Bureau of Home Furnishings and Thermal Insulation, "Flammability Test Procedure for Seating Furniture for Use in Public Occupancies," Technical Bulletin 133, Jan. 1991, pp. 1-28.

Brochure: *VISIL Technical Information*, Säteri Oy, Valkeakoski, Finland, 43 pages, date unknown, available as of filing date.

* cited by examiner

NONWOVEN HIGHLOFT FLAME BARRIER

RELATED APPLICATIONS

This application is a 35 U.S.C. 371 national application of PCT/US02/28743, filed Sep. 11, 2002, which claims the benefit of U.S. Provisional. Patent Application No. 60/318,335, filed Sep. 12, 2001.

FIELD OF THE INVENTION

The invention relates to a nonwoven highloft flame barrier well suited for use in mattress, upholstered furniture, fiber-filled bed clothing and transportation seating applications or any end use application where a highloft nonwoven material is desired for flame barrier purposes. A preferred nonwoven highloft flame barrier of the invention comprises a blend of fibers including "category 1" fibers that are inherently fire resistant and resistant to shrinkage by a direct flame, with melamine fibers being preferred either alone or in combination with other inherently flame retardant "category 1" fibers, "category 2" fibers from polymers made with halogenated monomers, and, preferably, additional fibers such as low-melt binder fibers, which are thermally activated in a highloft manufacturing process to provide low bulk density, resiliency and insulation properties in the end use application. Polymers made with halogenated monomers generate oxygen-depleting gases when exposed to flame temperatures These oxygen depleting gases help to prevent autoignition of the decomposition products coming from underlying layers of, for example, polyurethane foam and they also help extinguish residual flame which may emanate from overlying dress cover fabric or the like. The oxygen depleting gases from the polymers made with halogenated monomers also coat and protect the carbonaceous char formed during the decomposition of the inherently flame resistant fibers, thereby providing significantly longer time before the char disintegrates when exposed to air at open flame temperatures. These synergistic blends are then able to withstand extended periods of time with minimal shrinkage of the char barrier; thereby preventing flames from "breaking through" the char barrier and igniting underlying materials. Other component fibers can also, optionally, be included preferably at relatively low concentrations, such as: natural fibers, to improve product economics in the end use application. The highloft flame barrier of this invention also allows for the manufacture of open flame resistant composite articles, while also permitting the continued use of conventional non-flame retardant dress cover fabrics, conventional non-flame retardant fiberfills and conventional non-flame retardant polyurethane foams and the like.

BACKGROUND OF THE RELATED ART

It is known in the textile industry to produce fire resistant products for use in upholstered furniture, mattresses, pillows, bedspreads, comforters, quilts, mattress pads, automotive seating, public transportation seating, aircraft seating and the like, using woven, needlepunched or spunlace nonwoven or knit fabrics formed of natural or synthetic fibers, and then treating these fabrics with fire retarding chemicals. Conventional fire retarding (FR) chemicals include halogen-based, phosphorus-based and/or antimony-based chemicals. Unfortunately, such treated fabrics are heavier than similar types of non-fire retardant fabrics, and have reduced wear life. Although FR chemically treated fabrics will self-extinguish and exhibit limited melt behavior when a flame is removed, they do not perform well as a flame barrier against large direct flame assaults for even short periods of time. Typically FR chemically treated fabrics form brittle chars, shrink and crack open after a short exposure to a direct flame. This exposes the underlying material (e.g., polyester fiberfill and/or polyurethane foam), in a composite article, to the open flame. This fabric cracking and shrinking behavior may allow the underlying materials to ignite. When these fabrics made with FR treated cotton, FR polyester and other FR treated fabrics are used in composite articles such as upholstered furniture and mattresses, these composite articles are deemed unsuited for passing the more stringent open flame tests such as: California Test Bulletin 133 (January 1991) (Cal TB133), California Test Bulletin 129 "Flammability Test Procedure for Mattresses for use in Public Buildings", (October 1992) (Cal TB129) and British Standard 5852—Crib 5 (August 1982) (BS5852) without the use of additional flame barrier or FR backcoating materials.

Some of the flame barrier fabrics currently being used with the goal to pass the more stringent open flame tests, such as Cal TB129 and Cal TB133 include:

1) A woven polymer coated 100% fiberglass flame barrier (Sandel® Fabric, Sandel International Inc.)
2) A woven or knit core-spun yarn based flame barrier, where natural and/or synthetic fibers are wrapped around a multifilament fiberglass core and then optionally treated with FR chemicals and/or a coating of thermoplastic polyvinyl halide composition, such as polyvinyl chloride (Firegard® Seating Barriers, Intek; Firegard® Brand Products, Chiquola Fabrics, LLC)
3) A nonwoven hydroentangled spunlace flame barrier made of 100% p-aramid (Thermablock™ Kevlar® Z-11, DuPont Company).
4) A woven or knit core-spun yarn based flame barrier where natural and/or synthetic fibers are wrapped around a multifilament and/or spun p-aramid core yarn and then optionally treated with FR chemicals and/or a coating of thermoplastic polyvinyl halide composition, such as polyvinyl chloride (Firegard® Seating Barriers, Intek; Firegard® Brand Products, Chiquola Fabrics, LLC)

The disadvantages of the above mentioned flame barrier solutions for more stringent open-flame applications in mattresses, upholstered furniture and other fiber-filled applications include:

a) Woven flame barriers, especially when coated with FR materials, impart a stiff "hand" to the composite article, which negatively affect the feel of the final product.
b) Prior art woven, nonwoven and knit flame barriers must be either laminated to the decorative fabric or double upholstered during manufacturing. This increases the number and complication of the dress cover fabrics, thereby increasing manufacturing costs.
c) 100% fiberglass flame barriers have poor durability due to glass-to-glass abrasion.
d) Woven and knit flame barriers made with natural fiber wrapped core-spun yarns must be made in heavy weight constructions (i.e. ~10 opsy or 336 g/m$^2$) to be effective flame barriers, and can negatively affect the feel of the composite article.
e) Natural fiber wrapped core-spun yarn fabrics require additional FR chemical treatments and/or coatings of a thermoplastic polyvinyl halide composition, such as polyvinyl chloride to be effective in passing the more stringent open-flame tests. This negatively impacts the workplace by having to handle these chemicals and increases the exposure of chemicals to the consumer who uses the composite article.

f) Hydroentangled nonwoven spunlace flame barriers, containing significant amounts of p-aramid fibers, impart a yellow color to the flame barrier and negatively effect the look of the composite article, especially when used directly under white or light-colored decorative upholstery and/or mattress ticking fabrics.

g) Woven and knit flame barriers add a significant cost to the composite article because they require a yarn formation step, which is eliminated in the formation of a nonwoven flame barrier of the invention.

SUMMARY OF THE INVENTION

To overcome or conspicuously ameliorate the disadvantages of the related art, it is an object of the present-invention to provide a nonwoven highloft flame barrier able to pass stringent open flame tests. In its preferred usage in the present application, the term "flame barrier" means a product incorporated into a composite article that when tested with a composite type test method, such as: California Test Bulletin 129 for mattresses (TB Cal129) and California Test Bulletin 133 (Cal TB133) for upholstered furniture, the flame barrier allows for the continued use of conventional materials such as dress cover fabrics, fiber-fillings and polyurethane foams, while still passing these stringent large open flame tests. It is understood by someone skilled in the art that flame barriers made of the fiber blends described in this invention, even at overall lower basis weights, can be made to pass less stringent open flame tests such as small open flame tests.

In its preferred usage in the present application, the term "highloft" is in reference to (i) lofty, relatively low density nonwoven fiber structures, preferably having a greater volume of air than fiber; (ii) nonwoven materials that are produced with the purpose of building loft or thickness without increasing weight; and/or (iii) nonwoven fiber products that are not densified or purposely compressed over a significant portion of the product in the manufacturing process. The highloft nonwoven material of the present invention preferably has a basis weight of 75 to 600 g/m$^2$, more preferably 150 to 450 g/m$^2$ and even more preferably, for many intended uses, 300 to 375 g/m$^2$ The highloft nonwoven material of the present invention also preferably has a thickness falling within a range of 6 mm to 75 mm with a thickness range of 7-51 mm being deemed well suited for many uses of the present invention. As having too low a basis weight for a given thickness at the higher end of the above thicknesses could degrade the barrier effect in some instances, it is desirable for some applications to use the lower end basis weight values in conjunction with lower end thickness ranges while the higher end basis weight are generally not subject to the same concerns. Accordingly, a basis weight of 75 g/m$^2$ with a loft or thickness range of 6 mm to 13 mm, or 150 g/m$^2$ with a loft or thickness range of 6 mm to 25 mm, or 300 g/m$^2$ with a loft or thickness range of 10 mm to 50 mm, or 450 g/m$^2$ with a loft or thickness range of 20 mm to 60 mm, or 600 g/m$^2$ with a loft or thickness range of 19 mm to 75 mm represent preferred basis weight/thickness combinations under the present invention. Additional preferred combinations include, for example, a basis weight 150 g/m$^2$ (with a preferred thickness or loft range of 7 mm to 25 mm) to 450 g/m$^2$ (with a preferred thickness or loft range of 25 mm to 51 mm). Additional preferred combinations deemed well suited for many intended uses of the present application including flame barriers for bedding related products, include weight/thickness combinations of 300 g/m$^2$ (with a preferred thickness or loft range of 20 mm to 35 mm) to 375 g/m$^2$ (with a preferred thickness or loft range of 25 mm to 50 mm). The foregoing thickness ranges show preferred ranges relative to the noted basis weights that are well suited for typical intended usages of the present invention, but thickness levels above and below the noted ranges are also possible relative to the noted basis weights and vice versa depending of the desired flame barrier requirements and intended usage.

Thus in accordance with the present invention a highloft density level of 5 Kg/m$^3$ to 50 Kg/m$^3$ or, more preferably 6 Kg/m$^3$ to 21 Kg/m$^3$, and even more preferably, 7.5 Kg/m$^3$ to 15 Kg/m$^3$ is well suited for the flame barrier purposes of the present invention.

The preferred denier values of the fibers used in the nonwoven fiber blend of the present invention preferably are in the range of 0.8 to 200 dtex, with ranges of 0.9 to 50 dtex and 1 to 28 dtex being well suited for many applications of the present invention such as in conjunction with mattresses.

It is a further object of the invention to provide a composite article such a mattress and/or an upholstered furniture product manufactured with a nonwoven highloft flame barrier that passes more stringent open flame tests, such as Cal TB133 and Cal TB129 relative to a mattress alone (without a foundation such as a box spring).

Upon direct exposure to flame and high heat, the nonwoven highloft flame barrier of this invention forms a thick, flexible char with essentially no shrinkage in the x-y plane (e.g., "BASOFIL" melamine material by itself includes a shrinkage rate of less than 1% at 200° C. for 1 hour). This char forming behavior prevents cracking of the flame barrier, protecting the underlying layers of, for example, fiber-fill batting and/or foam materials in the composite article from being exposed to direct flame and high heat. The thick, flexible char also helps block the flow of oxygen and volatile decomposition gases, while slowing the transfer of heat by creating an effective thermal insulation barrier. The char forming behavior of the preferred fiber blend in the nonwoven highloft flame barrier considerably lengthens the time it takes the underlying materials to decompose and ignite, by generating oxygen depleting gases which do not allow the volatile decomposition vapors of, for example, polyurethane to autoignite, and also help existing "surface" flame to self-extinguish.

In accordance with a preferred embodiment of the invention, a thermally bonded nonwoven highloft flame barrier, for use in, for example, mattress, upholstered furniture, fiber-filled bed clothing and transportation seating applications is produced by making an intimate staple fiber blend from Category 1 and 2 optionally adding fibers from either or all of Categories 3, 4 and 5. The optional addition of Category 6 binder resins is also possible, such as in place of the Category 3 material or supplemental to the Category 3 material.

Category 1: Inherently flame-retardant, fibers such as; melamines, meta-aramids, para-aramids, polybenzimidazole, polyimides, polyamideimides, partially oxidized polyacrylonitriles, novoloids, poly(p-phenylene benzobisoxazoles), poly(p-phenylene benzothiazoles), polyphenylene sulfides, flame retardant viscose rayons (e.g., a viscose rayon based fiber containing 30% aluminosilicate modified silica, $S_iO_2$+$Al_2O_3$), polyetheretherketones, polyketones, polyetherimides, and combinations thereof).

The above noted melamine is an example of a Category 1 fiber that is inherently flame-retardant and shows essentially no shrinkage in the X-Y plane upon being subjected to open flame. Melamine fibers, for example, are sold under the tradename BASOFIL (BASF A.G.). Melamine resin fibers used in conjunction with this invention can be produced for example by the methods described in EP-A-93 965, DE-A-23 64 091, EP-A-221 330, or EP-A-408 947 which are incorporated herein by reference. For instance, preferred melamine resin fibers include as monomer building block (A) from 90 to 100 mol % of a mixture consisting essentially from 30 to 100, preferably from 50 to 99, particularly preferably from 85 to 95, particularly from 88 to 93 mol % of melamine and from 0 to 70, preferably from 1 to 50, particularly preferably from 5 to 15, particularly from 7 to 12 mol % of a substituted melamine I or mixtures of substituted melamine I.

As further monomer building block (B), the particularly preferred melamine resin fibers include from 0 to 10, preferably from 0.1 to 9.5, particularly from 1 to 5 mol %, based on the total number of moles of monomer building blocks (A) and (B), of a phenol or a mixture of phenols.

The particularly preferred melamine resin fibers are customarily obtainable by reacting components (A) and (B) with formaldehyde or formaldehyde-supplying compounds in a molar ratio of melamines to formaldehyde within the range from 1:1.15 to 1:4.5, preferably from 1:1.8 to 1:3.0, and subsequent spinning.

Suitable substituted melamine of the general formula I (I)

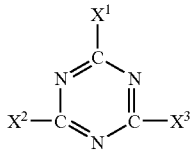

are those in which $x^1$, $x^2$, and $x^3$ are each selected from the group consisting of —$NH_2$, —$NHR^1$, and —$NR^1R^2$, although $x^1$, $x^2$, and $x^3$ must not all be —$NH_2$, and $R^1$ and $R^2$ are each selected from the group consisting of hydroxy-$C_2$-$C_{10}$-alkyl, hydroxy-$C_2$-$C_4$-alkyl-(oxa-$C_2$-$C_4$-alkyl)$_n$, where n is from 1 to 5, and amino-$C_2$-$C_{12}$-alkyl.

Hydroxy-$C_2$-$C_{10}$-alkyl is preferably hydroxy-$C_2$-$C_6$-alkyl such as 2-hydroxyethyl, 3-hydroxy-n-propyl, 2-hydroxyisopropyl, 4-hydroxy-n-butyl, 5-hydroxy-n-pentyl, 6-hydroxy-n-hexyl, 3-hydroxy-2,2-dimethylpropyl, preferably hydroxy-$C_2$-$C_4$-alkyl such as 2-hydroxyethyl, 3-hydroxy-n-propyl, 2-hydroxyisopropyl and 4-hydroxy-n-butyl, particularly preferably 2-hydroxyethyl or 2-hydroxyisopropyl.

Hydroxy-$C_2$-$C_4$-alkyl-(oxa-$C_2$-$C_4$-alkyl)$_n$ preferably has n from 1 to 4, particularly preferably in n=1 or 2, such as 5-hydroxy-3-oxapentyl, 5-hydroxy-3-oxa-2,5-dimethylpentyl, 5-hydroxy-3-oxa-1,4-dimethylpentyl, 5-hydroxy-3-oxa-1,2,3,4,5-tetramethylpentyl, 8-hydroxy-3,6-dioxaoctyl.

Amino-$C_2$-$C_{12}$-alkyl is preferably amino-$C_2$-$C_8$-alkyl such as 2-aminoethyl, 3-aminopropyl, 4-aminobutyl, 5-aminopentyl, 6-aminohexyl, 7-aminoheptyl, and also 8-aminooctyl, particularly preferably 2-aminoethyl and 6-aminohexyl, very particularly preferably 6-aminohexyl.

Substituted melamine particularly suitable for the invention include the following compounds:

2-hydroxyethylamino-substituted melamines such as
2-(2-hydroxyethylamino)-4,6-diamino-1,3,5-triazine,
2,4-di-(2-hydroxyethylamino)-6-amino-1,3,5-triazine,
2,4,6-tris(2-hydroxyethylamino)-1,3,5-triazine,
2-hydroxyisopropylamino-substituted melamines such as
2-(2-hydroxyisopropylamino)-4,6-diamino-1,3,5-trizaine,
2,4-di-(2-hydroxsyisopropylamino)-6-amino-1,3,5-triazine,
2,4,6-tris(2-hydroxyisopropylamino)-1,3,5-triazine,
5-hydroxy-3-oxapentylamino-substituted melamines such as
2-(5-hydroxy-3-oxapentylamino)-4,6-diamino-1,3,5-triazine,
2,4,6-tris-(5-hydroxy-3-oxapentylamino)-1,3,5-triazine,
2,4-di(5-hydroxy-3-oxapentylamino)-6-amino; 1,3,5-triazine and also 6-aminohexylamino substituted melamines such as
2-(6-aminohexylamino)-4,6-diamino-1,3,5-triazine
2,4-di(6-amino-hexylamino)-6 amino-1,3,5-triazine
2,4,6-tris(6-aminohexylamino)-1,3,5-triazine or mixtures of these compounds, for example a mixture of 10 mol % of
2-(5-hydroxy-3-oxapentylamino)-4,6-diamino-1,3,5-triazine,
50 mol % or 2,4-di(5-hydroxy-3-oxapentylamino)-6-amino-1,3,5-triazine and 40 mol % of 2,4,6-tris(5-hydroxy-3-oxapentylamino)-1,3,5-triazine.

Suitable phenols (B) are phenols containing one or two hydroxyl groups, such as unsubstituted phenols, phenols substituted by radicals selected from the group consisting of $C_1$-$C_9$-alkyl and hydroxyl, and also $C_1$-$C_4$-alkanes substituted by two or three phenol groups, di(hydroxyphenyl) sulfones or mixtures thereof.

Preferred phenols include phenol, 4-methylphenol, 4-tert-butylphenol, 4-n-octylphenol, 4-n-nonylphenol, pyrocatechol, resorcinol, hydroquinone, 2,2-bis(4-hydroxphenyl) propane, Bis(4-hydroxyphenyl)sulfone, particularly preferably phenol, resorcinol and 2,2-bis(4-hydroxyphenyl) propane.

Formaldehyde is generally used in the form of an aqueous solution having a concentration of, for example, from 40 to 50% by weight or in the form of compounds which supply formaldehyde in the course of the reaction with (A) and (B), for example in the form of oligomeric or polymeric formaldehyde in solid form, such as paraformaldehyde, 1,3,5-trioxane or 1,3,5,7-tetroxane.

The particularly preferred melamine resin fibers are produced by polycondensing customarily melamine, optionally substituted melamine and optionally phenol together with formaldehyde or formaldehyde-supplying compounds. All the components can be present from the start or they can be reacted a little at a time and gradually while the resulting precondensates are subsequently admixed with further melamine, substituted melamine or phenol.

The polycondensation is generally carried out in a conventional manner (See EP-A-355 760, Houben-Weyl, Vol. 14/2, p. 357 ff).

The reaction temperatures used will generally be within the range from 20 to 150° C., preferably 40 to 140° C.

The reaction pressure is generally uncritical. The reaction is generally carried out within the range from 100 to 500 kPa, preferably at atmospheric pressure.

The reaction can be carried out with or without a solvent. If aqueous formaldehyde solution is used, typically no solvent is added. If formaldehyde bound in solid form is used, water is customarily used as solvent, the amount used being generally within the range from 5 to 40, preferably from 15 to 20, percent by weight, based on the total amount of monomer used.

Furthermore, the polycondensation is generally carried out within a pH range above 7. Preference is given to the pH range from 7.5 to 10.0, particularly preferably from 8 to 9.

In addition, the reaction mixture may include small amounts of customary additives such as alkali metal sulfites, for example sodium metabisulfite and sodium sulfite, alkali metal formates, for example sodium formate, alkali metal citrates, for example sodium citrate, phosphates, polyphosphates, urea, dicyandiamide or cyanamide. They can be added as pure individual compounds or as mixtures with each other, either without a solvent or as aqueous solutions, before, during, or after the condensation reaction.

Other modifiers are amines and aminoalcohol such as diethylamine, ethanolamine, diethanolamine or 2-diethylaminoethanol.

Examples of suitable fillers include fibrous or pulverulent inorganic reinforcing agents or fillers such as glass fibers, metal powders, metal salts or silicates, for example kaolin, talc, baryte, quartz or chalk, also pigments and dyes. Emulsifiers used are generally the customary nonionic, anionic, or cationic organic compounds with long-chain alkyl radicals.

The polycondensation can be carried out batchwise or continuously, for example in an extruder (See EP-A-355 760), in a conventional manner.

Fibers are produced by generally spinning the melamine resin of the present invention in a conventional manner, for example following addition of a hardener, customarily acids such as formic acid, sulfuric acid, or ammonium chloride, at room temperature in a rotospinning apparatus and subsequently completing the curing of the crude fibers in a heated atmosphere, of spinning in a heated atmosphere while at the same time evaporating the water used as solvent and curing the condensate. Such a process is described in detail in DE-A-23 64 091.

If desired, the melamine resin fibers may have added to them up to 25% preferably up to 10%, by weight of customary fillers, especially those based on silicates, such as mica, dyes, pigments, metal powders and delusterants.

Other Category 1 fibers include: meta-aramids such as poly(m-phenylene isophthalamide), for example, those sold under the tradenames NOMEX by E. I. Du Pont de Nemours and Co., TEIJINCONEX by Teijin Limited and FENYLENE by Russian State Complex; para-aramids such as poly(p-phenylene terephthalamide), for example, that sold under the tradename KEVLAR by E. I. Du Pont de Nemours and Co., poly(diphenylether para-aramid), for example, that sold under the tradename TECHNORA by Teijin Limited, and those sold under the tradenames TWARON by Acordis and FENYLENE ST (Russian State Complex); polybenzimidazole such as that sold under the tradename PBI by Hoechst Celanese Acetate LLC, polyimides, for example, those sold under the tradenames P-84 by Inspec Fibers and KAPTON by E. I. Du Pont de Nemours and Co.; polyamideimides, for example, that sold under the tradename KERMEL by Rhone-Poulenc; partially oxidized polyacrylonitriles, for example, those sold under the tradenames FORTAFIL OPF by Fortafil Fibers Inc., AVOX by Textron Inc., PYRON by Zoltek Corp., PANOX by SGL Technik, THORNEL by American Fibers and Fabrics and PYROMEX by Toho Rayon Corp.; novoloids, for example, phenol-formaldehyde novolac, for example, that sold under the tradename KYNOL by Gun Ei Chemical Industry Co.; poly(p-phenylene benzobisoxazole) (PBO), for example, that sold under the tradename ZYLON by Toyobo Co.; poly(p-phenylene benzothiazoles) (PBT); polyphenylene sulfide (PPS), for example, those sold under the tradenames RYTON by American Fibers and Fabrics, TORAY PPS by Toray Industries Inc., FORTRON by Kureha Chemical Industry Co. and PROCON by Toyobo Co.; flame retardant viscose rayons, for example, those sold under the tradenames LENZING FR by Lenzing A. G. and VISIL by Säteri Oy Finland; polyetheretherketones (PEEK), for example, that sold under the tradename ZYEX by Zyex Ltd.; polyketones (PEK), for example, that sold under the tradenane ULTRAPEK by BASF; polyetherimides (PEI), for example, that sold under the tradename ULTEM by General Electric Co.; and combinations thereof.

The most preferable Category 1 fibers are also those that are either white, off-white, transparent or translucent in color, since any other color in the nonwoven highloft flame barrier can negatively effect the look of the composite article, especially when used directly under white or light-colored decorative upholstery and/or mattress ticking fabrics. Thus, when considering that, on an achromatic scale, white paper has a reflectance value of 80% or more and black has about a 10% reflectance value, the preferred white or off white fiber color falls much closer to the 80% reflectance end of the range (e.g., +/−20). In this regard, melamine fibers are particularly well suited for use in the present invention. Melamine fibers also have outstanding insulative properties, exhibiting a thermal resistance of 0.10 Watts/meter—degree Kelvin and they also provide an endothermic cooling effect, absorbing 5 watts of energy per gram of fiber, when thermally decomposing between 370-550° Celsius.

An additional inherently flame resistant fiber which is suitable for use in the present invention, preferably used in combination with the melamine (endothermic) fiber noted above, is a cellulosic fiber such as a viscose rayon based fiber having, for example, a high silica content built into the fiber to provide an insulating barrier in the fiber. A suitable fiber of this nature is a viscose rayon based fiber containing 33% aluminosilicate modified silica ($S_iO_2$+$Al_2O_3$) made by Säteri Oy in Valkeakoski, Finland. The fiber is commonly referred to and has a trade mane of Visil® fiber. This material is believed to thermally decompose upon being subjected to a flame into a grid structure with openings that could provide for volatile liquid passage (e.g. decomposed polyurethane volatile liquid) which could ignite on the opposite side of the grid structure. Thus, it is further believed that the use of sufficient category 1 fibers such as melamine fibers provides for filling of this grid structure with char material such as carbon char generated by a melamine fiber Category 2: Fibers produced (e.g., extruded) from polymers made with halogenated monomers, generate oxygen depleting gases which help to prevent volatile decomposition vapors of underlying or adjacent materials such as polyurethane to autoignite, help prolong the life of the category 1 material (mixes or non-mixes) when subjected to open flame and also help existing "surface" flame to self-extinguish. These fiber types include:

Chloropolymeric fibers, such as those containing polyvinyl chloride or polyvinylidene homopolymers and copolymers, for example, those sold under the tradenames THERMOVYL L9S & ZCS, FIBRAVYL L9F, RETRACTYL L9R, ISOVYL MPS by Rhovyl S. A; PIVIACID, Thueringische; VICLON by Kureha Chemical Industry Co., TEVIRON by Teijin Ltd., ENVILON by Toyo Chemical Co. and VICRON, made in Korea; SARAN by Pittsfield Weaving, KREHALON by Kureha Chemical Industry Co. and OMNI-SARAN by Fibrasomni, S. A. de C. V.; and modacrylics which are vinyl chloride or vinylidene chloride copolymer variants of acrylonitrile fibers, for example, those sold under the tradenames PROTEX by Kaneka containing antimony oxide and SEF by Solutia; and combinations thereof.

Fluoropolymeric fibers such as polytetrafluoroethylene (PTFE), for example, those sold under the tradenames TEFLON TFE by E. I. Du Pont de Nemours and Co., LENZING PTFE by Lenzing A. G., RASTEX by W. R. Gore and Associates, GORE-TEX by W. R. Gore and Associates, PROFILEN by Lenzing A. G. and TOYOFLON PTFE by Toray Industries Inc., poly(ethylene-chlorotrifluoroethylene) (E-CTFE), for example, those sold under the tradenames HALAR by Albany International Corp. and TOYOFLON E-TFE by Toray Industries Inc., polyvinylidene fluoride (PVDF), for example, those sold under the tradenames KYNAR by Albany International Corp. and FLORLON (Russian State Complex), polyperfluoroalkoxy (PFA), for example, those sold under the tradenames TEFLON PFA by E. I. Du Pont de Nemours and Co. and TOYOFLON PFA by Toray Industries Inc., polyfluorinated ethylene-propylene (FEP), for example, that sold under the tradename TEFLON FEP by E. I. Du Pont de Nemours and Co.; and combinations thereof.

Category 3: Low-melt binder fibers such as:

Low-melt bicomponent polyesters, such as Celbond® sold by Kosa company

Polypropylenes, such as T-151 as sold by Fiber Innovation Technology or by American Fibers and Yarns Co.

Category 3 fiber combinations

Low melt fibers are generally those fibers that have melting points lower than the melting points or degradation temperatures of the other fibers in the blends. Typical "low-melt" fibers (polyester and polyolefins) used in the industry have melting points of 110° C. to 210° C. Regular fill polyester (high crystallinity) melts at approximately 260° C. Most thermal bonding ovens are limited to operating temperatures below 230° C. for fire and conveyor degradation issues.

Category 4: Natural fibers such as:

Cotton, wool, silk, mohair, cashmere

Category 4 fiber combinations

Category 5: Non-flame retardant fibers such as;

nylons, polyesters, polyolefins, rayons, acrylics, cellulose acetates and polylactides such as those available from Cargill Dow Polymers Category 5 fiber combinations Category 6: Halogenated binder resins such as those based on vinylchloride and ethylene vinyl chloride.

The fiber blend level concentrations (by weight percentages) in the nonwoven highloft flame barrier are as follows:

Category 1: 10-85%, more preferably 20-70% and even more preferably 30-60%.

Category 2: 10-85%, more preferably 20-70% and even more preferably 30-60%.

Category 3: 0-30%, more preferably 5-25% and even more preferably 10-20%.

Category 4: 0-40%, more preferably 5-30% and even more preferably 10-20%.

Category 5: 0-40%, more preferably 5-30% and even more preferably 10-20%.

Category 6: If used, 0-40%, more preferably 5-30% and even more preferably 10-20%.

Although the preferred embodiment of the invention is a thermally bonded nonwoven highloft, it is also possible to utilize the fibers mentioned in Categories 1, 2, 4 and 5 and utilize binder materials from Category 6 to make a suitable resin bonded highloft flame barrier of the invention. The thermal bonded blend may also be coated (e.g., on one or two sides) with a light sprayed Category 6 resin coating to "lock" the surface fibers in place. This prevents the surface fibers from percolating or migrating through the ticking after subjected to use. Fiber percolation gives an undesirable fuzzy appearance to the upholstery ticking.

The oxygen depleting gases generated by the category 2 fiber are beneficial in combination with the category 1 material. That is, in addition to helping prevent autoignition of the decomposition products coming from underlying layers, such as polyurethane foam or the like and helping to extinguish any residual flame emanating from overlying material such as dress cover fabric, the oxygen depleting gases from the polymers made with halogenated monomers also coat and protect the carbonaceous char formed during the decomposition of the inherently flame resistant fibers. In this way, there is provided a significantly longer time before the char disintegrates when exposed to air at open flame temperatures. This synergistic blending under the present invention is thus able to withstand extended periods of time with minimal shrinkage of the char barrier; thereby preventing flames from "breaking through" the char barrier and igniting underlying materials. For this reason the combination of some amount of the category 1 and 2 fibers is more preferable than, for example, reliance on category 1 fiber alone (e.g., in an amount at an intermediate to higher end of the above noted range in conjunction with a low density highloft barrier) and without the benefits of the category 2 material.

Other component fibers can also, optionally, be included, preferably at relatively low concentrations, such as: natural fibers, to improve product economics in the end use application.

The above percentage ranges for the various categories is in reference to the percentage by weight of a single layer of material (e.g. a flame barrier whose entire thickness is formed of a common fiber blend or in reference to one layer of a multilayer flame barrier with the other layers either also being provided for flame barrier purposes or not provided for flame barrier purposes). Moreover, the above percentages by weight can also be considered as being applicable to the percentage by weight of the sum of various layers of a multilayer flame barrier. For example, the present invention is intended to include within its scope a multilayer flame barrier combination having the same or differing percentages of materials from categories 1 and/or 2 (including zero percent in one layer of one of the categories 1 and 2 material with the other layer making up the difference) amongst two or more of its layers. For instance, the multilayer flame barrier can include one layer designed to provide or emphasize the category 1 material and a second layer designed to provide or emphasize the desired percentage of the category 2 material. As can be seen from the few examples directly above, and the additional examples described hereafter, the present invention provides a high degree of versatility in forming a flame barrier, although, as will become more apparent below, certain combinations of materials, particularly the category 1 and 2 materials, can provide highly advantageous flame barrier functioning. Also, from the standpoint of reducing manufacturing complexity and cost, for example, a single layer or non-multi-layer flame barrier having common blend makeup throughout its thickness (based on, for example, an inputted fiber mix blend "recipe" based on the above noted potential category combinations into a computer processor controlling the highloft, nonwoven product manufacturing process) is preferred for many applications.

The highloft flame barrier of this invention also allows for the manufacture of open flame resistant composite articles, while also permitting the continued use of conventional non-flame retardant dress cover fabrics, conventional non-flame retardant fiberfills, and conventional non-flame retardant polyurethane foams, etc.

In accordance with another aspect of the invention, the highloft flame barrier herein described allows for the manufacture of open flame resistant end-use composite articles by incorporating the barrier material with additional composite article components such as: conventional non-flame retardant dress cover fabrics, conventional non-flame retardant fiber-fills and conventional non-flame retardant polyurethane foams, which are already used, for example, in making upholstered furniture, mattresses, pillows, bedspreads, comforters, quilts, mattress pads, automotive seating, public transportation seating and aircraft seating. The highloft flame barrier of the invention can be used without lamination to the dress cover fabric, which is an advantage over certain forms of currently available flame barriers, since the laminating resins tend to stiffen the "hand" of the upholstered fabric. The highloft flame barrier product may also be used as a substitute for conventional non-FR highloft batting. This highloft barrier can also, advantageously, be laminated, for example by adhesive coating, to a layer of polyurethane foam, as is current practice in the much of the upholstered furniture industry. This reduces the number of stock units that must be handled in the furniture manufacturing process. Thus, the present invention also provides for continued use of conventional non-flame retardant materials in, for example, upholstered furniture and mattress formation, without altering or disrupting the conventional composite article manufacturing process, except perhaps making the process more simple by reducing one or more steps in a preexisting process such as removing a step of applying FR material to the article. With the flexibility of sizing in the above described highloft flame barrier it is also possible to replace a preexisting component (e.g., fiber batting) with a similar dimensioned highloft flame barrier replacement (either alone or as a laminate with some other material such as a lesser amount of a preexisting conventional material) without disrupting the overall composite article manufacturing technique.

The composite articles produced and thus the flame barrier itself and each additional component of the composite article can advantageously be free of any fire resistant coatings and chemicals, and yet still pass the aforementioned stringent open flame tests.

DETAILED DESCRIPTION OF PREFERRED EMBODIMENTS OF THE INVENTION

The present invention is directed at providing a nonwoven highloft flame barrier, and particularly one that, when tested in a composite article with a composite test method, such as: California Test Bulletin 129 for mattresses (TB Cal129) and California Test Bulletin 133 (Cal TB133) for upholstered furniture, the flame barrier allows for the continued use of conventional dress cover fabrics, fiber-fillings and polyurethane foams and the like, while still passing these stringent large open flame tests. It is understood by someone skilled in the art that flame barriers made of the fiber blends described in this invention, even at overall lower basis weights, can be made to pass less stringent small open flame tests.

The term "highloft" is used in a general sense to indicate lofty, relatively low density nonwoven fiber structures. These materials typically have a greater volume of air than fiber. The term is also used to describe nonwoven materials that are produced with the purpose of building loft or thickness without increasing weight. As used herein, highloft also refers to products that are not densified or purposely compressed in the manufacturing process. Representative examples of basis weights, thickness and other blend and formation characteristics for the highloft material of the present invention are provided further below.

The nonwoven-highloft flame barrier of the present invention is particularly well suited for use as component material in the manufacture of furniture, bedding, bed clothing, etc., so that added protection, such as a coating of FR material on, for example, an outer upholstery covering, does not have to be used to make the composite article open-flame resistant. The present invention is thus designed to be incorporated in the manufacturing process of many composite articles without disruption of their current processes and thus the present invention provides a non-disruptive manufacturing substitute for the materials currently used by manufacturers or articles such as padding, cushioning, quilting layers, etc.

Composite articles manufactured with the described nonwoven highloft flame barrier have the look, feel and surface characteristics of the same products made without the subject of this invention while providing the flame barrier characteristics. For example, one of the standard tests for measuring the open flame resistance of a mattress is California Test Bulletin 129. According to this test, a full-scale mattress is exposed to a 3 minute flame burner, held horizontally at 1 inch from the bottom/center on the side border of the mattress. Mattresses of the present invention can employ the above-described nonwoven highloft flame barrier, by having the barrier, for example, quilted directly under the mattress ticking fabric and above a layer of standard polyester highloft batting or standard non-FR polyurethane foam. Additional stringent open flame tests for which composite articles of the present invention, or composite mock-ups representing these articles, are intended to pass when this barrier is incorporated include: California Test Bulletin 133, the proposed Consumer Product Safety Commission (CPSC) Flammability Test, the composite British Standard 5852—Crib 5, the British Standard 7176, the British Standard 7177.

Formation of the present invention preferably involves chemical, thermal, or no bonding formation of a nonwoven-highloft flame barrier. The use of these techniques is preferred over a technique such as a mechanical bonding technique. A mechanical bonding technique relies on entanglement of the fibers to add sufficient strength to resist destruction from normal handling and intended usage. The conventional mechanical bonding techniques used are typically based on hydro-entanglement, needlepunching and/or stitchbonding, or any other technique that uses mechanical means to physically entangle the fibers after carding. The use of the mechanical bonding techniques are less preferred under the present invention than chemical, thermal, or no bonding formation techniques, as the mechanical means of bonding significantly reduces the loft or thickness of the material because the physical orientation of the fibers relative to each other is manipulated resulting in a lowering of the thickness or loft for a given weight, and a corresponding increase in density.

The non-mechanical highloft bonding utilized in the present invention is helpful in providing barrier characteristics, which render the present invention capable of achieving the high open flame resistance described above. While thermal and/or spray resin bonding is preferred to maintain the desired highloft attributes combinations of mechanical, thermal and/or chemical bonding techniques may be relied upon such as the above noted surface resin spray to a thermally bonded non-woven barrier. As an additional example of a combination of techniques which retains the desired highloft attributes, mechanical bonding equipment may be used in conjunction with other non-mechanical bonding techniques to provide various finished good attributes. For example, one side (e.g., top or bottom) of the material can be densified or closed using mechanical techniques while the other side remains lofty. This creates various airflow properties and produces hand or surface feel variances. The loft values provided herein can thus be considered to represent the value of the non-mechanically bonded portion or area of the highloft material. If mechanical bonding is used in conjunction with the above noted non-mechanical bonding techniques, it is preferably used only in a minor context such as only affecting a small percentage of the overall portion (volume or area) of the flame barrier (e.g. less than 10%). Also, if mechanical bonding techniques are employed over a larger area of the material, a minor degree of bonding by mechanical means is preferred to essentially preserve initial loft and density values (e.g., a resultant loft or thickness value that is within 20% of one that is entirely free of the finished goods mechanical bonding supplementation).

In chemical bonding, a resin or adhesive, typically in latex form, is sprayed on the carded web and then dried and/or cured to bind the fibers together in their current orientation. The substance sprayed acts as a "glue" holding the fibers together and producing bond points at the intersection or the point where two or more fibers are in contact. Saturation bonding is similar except the web is immersed into a bath of resin instead of the spray application of the resin. The immersion method is less preferred given the flammable nature of most chemical binders. FR additives can be added to the resin, but these are costly and increase process costs as well, and as described above, are not needed for preferred arrangements of the present invention. The chemical binder method has environmental issues that also contribute to the saturation method not being the preferred method of binding for many applications.

Thermal bonding utilizes binder fiber. Binder fiber is typically composed of polymer(s) that have a lower melting point than the "fill" fibers or other fibers in the blend. The binder fiber then melts in the presence of heat in a subsequent processing step. The binder, in molten form in the presence of heat, flows to the intersection of fibers and upon cooling re-hardens and forms a bond. These bonds allow the fibers to remain in their current orientation. Binder fiber can be a solid, single polymer fiber with a significant lower melting point than the fill fibers in the blend. The binder can also be a sheath/core fiber whereas the sheath component is a polymer of low melting point with the core being a polymer of a relatively higher melting point.

These thermal/adhesive bonding techniques produce finished materials with significantly higher loft or thicknesses for the same basis weight than mechanical bonding means. The thickness and loft of the product is beneficial in the preferred usage of the present invention in that it provides good cushioning properties, finished quilt panel aesthetics, and is readily available for general use in the suggested articles (e.g. no alteration in the article in which the barrier is being used to accommodate the barrier). The present invention can also be produced and incorporated into articles without any bonding. Non bonded nonwovens are commonly referred to in the art as "soft goods". Even without bonding, the material will remain in a highloft configuration. Soft goods are used, for example, in certain composite articles such as furniture and sufficiently retain their assemblage by way of the natural entanglement (i.e., non-mechanical entanglement) brought about in the highloft manufacturing web forming process i.e. carding, garneting, airlay. In some instances thin laminate strips or other transport/handling facilitation means are added to one surface of the body of the soft goods.

The highloft non-woven barrier material of the present invention can be manufactured in a variety of ways some of which are described in the "Non-Woven Textile Fabrics" section in the Kirk-Othmer "Encyclopedia of Chemical Technology" 3rd Ed. Vol. 16 pgs 72-124, which section is incorporated herein by reference. A preferred manufacturing process for forming the barrier of the present involves passing supplied fiber mass from a compressed bale by way of a feed device, such as a feed conveyor or rolls, to an opener designed to break apart the fiber mass, thus initiating fiber opening and separation, passing opened fiber mass to a weigh device, continuous or batch, designed to weigh the opened fiber mass, blending weighed amounts of the desired amount of opened fiber mass in a blender to achieve a homogeneous blend of the desired amounts of the opened fiber material. The manufacturing process further includes passing the opened, weighed and blended fiber mass to a non-woven forming device such as a carding device to form a web of non-woven material. Preferably the process involves cross lapping or layering webs in a cross lapping device of the like until the desired thickness of predetermined basis weight non-woven highloft material is obtained.

Preferably each of the above relied upon stages is controlled and coordinated through use of a central processor in communication with the various pieces of "equipment in the overall system." This allows, for example, an operator to input a desired blend recipe having the above noted desired percentage by weight amounts of the desired categories of material to be used and to control the basis weight of the blended fiber and thickness (e.g., amount of cross-lapping webs) of the desired layer of non-woven highloft flame barrier. The opening and blending of the aforementioned fibers is preferably carried out with high quality fiber openers and blenders that are designed for accurately producing a homogeneous blend of the above described fibers. Suitable opening and blending equipment includes a bale opener and fine opener manufactured by Fiber Controls of Gastonia, N.C. and a blended fiber reserve feed chute manufactured by Dilo Group of Bremen, Germany. Opening is preferably carried out through the use of various stages of opening wherein each successive stage represents finer opening and more fiber separation to help in achieving a more homogeneous and accurate resultant blend. Following the various opening stages, all opened fiber components for use in the desired resultant blend are preferably weighed before blending to ensure accurate percentage of blend. This blending step can be achieved without weighing but poor blending can potentially negatively affect the final flame resistance performance of the flame barrier of the present invention by allowing relative low concentrations of key components in an area of the material.

Blending involves mixing the weighed fibers through layering of the weighed components and feeding through a blending roll beater (which can be configured using pins or saw tooth wire) turning at a high rate of speed relative to the speed of the weighed components and transported into a chute feed or reserve feed hopper, such as the "Direct Feed" brand hopper sold by Dilo Group of Bremen, Germany. Further blending can be accomplished by processing the pre-blended components through a reserve blending mixing chamber such as the Type 99 Reserve Chamber sold by Fiber Controls, Inc. of Gastonia, N.C.

The opened and blended fibers are then processed through a high quality non-woven carding device (e.g., a Type 1866 Highloft Non-woven Carding device sold by Dilo Group of Bremen, Germany) and the resulting web is crosslapped or layered (e.g., by way of a CL-4000 series crosslapper sold by Autefa, Germany) to form a highloft web. In a typical carding process there is utilized a series of wire wound rolls turning at various speeds (depending on the application and product to be carded) which can be controlled by the control processor. Most carding devices consist of a breaker section with a large main roller with smaller diameter rolls positioned around the arc of the main roller. A second, larger main roller is configured with a doffer roll between the breaker main and itself A series of smaller rollers are configured around the second main roller. Two doffer rollers positioned over top one another in a vertical arrangement remove the carded web from the carding device. Various configurations of carding devices are available. Speeds of the rolls in a given carding devices are usually adjustable to allow for processing a wide range of fibers and deniers. In the carding device, the fiber is carded or combed by the action of the moving saw-tooth wire against the fiber mat being fed through the machine. This same process is accomplished through garneting and other various web forming machinery such as airlay webs. The web exiting the carding devices or web former can be used directly or can be crosslapped, vertically or horizontally, to build product loft or thickness and weight. Crosslapping layers or stacks of the continuous card web allows for the formation of non-woven material to various desired thicknesses and weights. The web, in one embodiment of the invention, incorporating binding fiber, is carried through a forced air, gas-fired continuous oven with temperatures up to 500° F. so that bonding of the web takes place. Bonding temperatures are dependent on the binder components in the blends. The material is then subjected to final processing such as having the material rolled on rolls and slit to width per application. The material can also be cut into panel size pieces depending on specific applications.

The above described preferred "equipment assemblage" is capable of producing highloft nonwoven fiber blends with weights of 40 g/m$^2$ (with thickness range of 5 mm to 10 mm) through 1800 g/m$^2$ and higher (with a thickness or loft range of 150 mm to 250 mm and higher.)

The highloft nonwoven material of the present invention preferably has a basis weight of 75 to 600 g/m$^2$, more preferably 150 to 450 g/m$^2$ and even more preferably, for many intended uses, 300 to 375 g/m$^2$. The highloft nonwoven material of the present invention also preferably has a thickness falling within a range of 6 mm to 75 mm with a thickness range of 7 to 51 mm being well suited for many uses of the present invention. As having too low a basis weight for a given thickness at the higher end of the above basis weight ranges could degrade the barrier effect in some instances, it is desirable for some applications to use the lower end basis weight values in conjunction with lower end thickness ranges while the higher end basis weight are generally not subject to the same concerns. Accordingly, a basis weight level of 75 g/m$^2$ (with a preferred loft or thickness range of 6 mm to 13 mm, to 450 g/m$^2$ (with a preferred loft or thickness range of 25 mm to 51 mm) is representative of some preferred ranges of the present application. Additional preferred combinations, well suited for many intended uses of the present application including flame barriers for bedding related products, include weight/thickness combinations of 300 g/m$^2$ (with a preferred thickness or loft range of 20 mm to 35 mm) to 375 g/m$^2$ (with a preferred thickness or loft range of 25 mm to 50 mm).

Thus in accordance with the present invention a highloft density level of 5 Kg/m$^3$ to 50 Kg/m$^3$ or, more preferably 6 Kg/m$^3$ to 21 Kg/m$^3$, and even more preferably, 7.5 Kg/m$^3$ to 15 Kg/m$^3$ is considered well suited for the flame barrier purposes of the present invention.

The preferred denier values of the fibers used in the nonwoven fiber blend of the present invention preferably are in the range of 0.8 to 200 dtex, with ranges of 0.9 to 50 dtex and 1 to 28 dtex being well suited for many applications of the present invention such as in conjunction with mattresses.

The above described "highloft" form is a preferred form of the flame barrier of the present invention as it provides, among other qualities, increased thermal insulative qualities. This thermal insulation effect helps prevent components, such as polyurethane foams, from auto ignition although the flame has not actually breached the barrier to expose the foam. Higher or lower lofts, weights and densities are possible, but the above ranges are well suited for the preferred usage in providing a "seamless" open flame barrier component in an article such as those describe above while avoiding, for example, degrading the aesthetics, feel, comfort and other desired qualities in those articles and without introducing undesirable manufacturing complexities and cost. Also, too low a basis weight for too high a thickness can lead to areas in the barrier which a flame may be able to pass through. The stated values above are relative to pre-assembly of a composite article configurations. The post assembly thickness and hence density values can vary depending on assembly techniques, but generally a loss of thickness is realized not to exceed 50% of original height. As an example, 10% to 25% in loss of loft could be realized in a quilted panel for mattress construction. This usually happens as a result of the fiber being quilted and sewn to a tick and being held at a lower loft as a result of the mattress manufacturing process. The thickness and basis weight values for the pre-assembly configuration are established so as to be functional to the level of desired flame barrier functioning upon final assembly in a desired composite article.

The following non-limiting "Composite Article" test examples I and II are set forth to demonstrate the effectiveness of a mattress manufactured with the flame barrier of the invention to pass a stringent large open flame test (TB Cal 129) while the Comparative Composite Article Example provides a comparative test sample. These examples are followed below by an additional "Composite Article" test example III featuring a combination mix of different category 1 fiber types. Each of these test examples were carried out on a mattress alone (i.e., without foundation or box-spring).

COMPOSITE ARTICLE EXAMPLE I

A commercial twin mattress constructed with the following materials:

Mattress Quilt Panel, Sewn with Non-FR Quilting Thread, Consisting of:

Class A commercial mattress ticking fabric from Blumenthal Mills Inc. (Aristocrat "22" T-VBS 701)

1st layer under the ticking consisting of:

a nonwoven thermally bonded highloft flame barrier consisting of a fiber blend of:

55% melamine/30% polyester (100% PET (polyethylene-terephalate) at 260° C. melting temperature)/15% binder fiber "PET/PET" binder fiber 50%/50% sheath/core with the sheath having a 100° C. melting temperature and the core a 260° C. melting temperature.

with a preferred average batt basis weight range of 153 g/m$^2$ and average thickness of 25 mm in an uncompressed state.

2nd layer under the ticking consisting of:

nonwoven thermally bonded highloft flame barrier consisting of a fiber blend including:

20% melamine/60% modacrylic (PROTEX-M from Kaneka of Japan)/20% binder fiber with a preferred average batt basis weight of 229 g/m$^2$ and average thickness of 25 mm in an uncompressed state.

3rd layer under the ticking consisting of:

nonwoven thermally bonded highloft 100% "slickened" polyester batt from Western Nonwovens, Inc.

with a preferred batt basis weight of 305 g/m$^2$ and thickness of 25 mm in an uncompressed state.

4th layer under the ticking consisting of:

1" layer of non-flame retardant (FR) polyurethane foam from Carpenter Co. (R17S type)

5th layer of 1 opsy nonwoven spunbond polyester scrim cloth from Hanes Converting Co.

Mattress Border Panel, Sewn with Non-FR Quilting Thread, Consisting of:

Class A commercial mattress ticking fabric from Blumenthal Mills Inc. (Aristocrat "22" T-VBS 701)

1st layer under the ticking consisting of:

a nonwoven thermally bonded highloft flame barrier consisting of a fiber blend of:

55% melamine/30% polyester/15% binder fiber with a preferred average batt basis weight of 153 g/m$^2$ and average thickness of 25 mm in an uncompressed state.

2nd layer under the ticking consisting of:

nonwoven thermally bonded highloft flame barrier consisting of a fiber blend including:

20% melamine/60% modacrylic/20% binder fiber with a preferred average batt basis weight of 229 g/m$^2$ and average thickness of 25 mm in an uncompressed state.

3rd layer of 0.5 opsy nonwoven spunbond polyester scrim cloth from Hanes Converting Co.

Mattress Innersprings Layers, Consisting of:

1st layer over innersprings of 100% polyester netting

2nd layer over innersprings of 0.375" non-FR polyurethane foam from Carpenter Co. (L32S type)

3rd layer over innersprings of 1.75" non-FR polyurethane foam from Carpenter Co. (S17S type)

The mattress quilt panel was sewn to the mattress border panel with 1.25" wide Firegard mattress tape (style 4368) Firegard thread and all mattress corners were protected by standard loose cotton fill.

The above constructed twin mattress was tested at Omega Point Laboratories (Elmendorf, Tex.) according to California Test Bulletin 129. All flame ceased on the mattress after 5 minutes and 26 seconds and all smoldering of the mattress ceased after 6 minutes and 0 seconds. The Peak Rate of Heat Release was 19.69 KW (maximum allowable rate of heat release is 100 KW), the Total Heat Release was 2.53 MJ (maximum allowable in First 10 minutes is 25 MJ) and the Weight Loss in the First 10 minutes was 0.5 lbs (maximum allowable in First 10 minutes is 3 lbs). This test was considered a significant pass of CAL TB 129.

COMPOSITE ARTICLE EXAMPLE II

A commercial twin mattress constructed with the following materials:

Mattress Quilt Panel, Sewn with Non-FR Quilting Thread, Consisting of:

Class A commercial mattress ticking fabric from Blumenthal Mills Inc. (Aristocrat "22" T-VBS 701)

1st layer under the ticking consisting of:

nonwoven thermally bonded highloft flame barrier consisting of a fiber blend including:

38% melamine/47% modacrylic/20% binder fiber with a preferred average batt basis weight of 381 g/m$^2$ and average thickness of 32 mm in an uncompressed state.

2nd layer under the ticking consisting of:

1st layer of non-flame retardant (FR) polyurethane foam from Carpenter Co. (R17S type)

3rd layer of 1 opsy nonwoven spunbond polyester scrim cloth from Hanes Converting Co.

Mattress Border Panel, Sewn with Non-FR Quilting Thread, Consisting of:

Class A commercial mattress ticking fabric from Blumenthal Mills Inc. (Aristocrat "22" T-VBS 701)

1st layer under the ticking consisting of:

nonwoven thermally bonded highloft flame barrier consisting of a fiber blend including:

38% melamine/47% modacrylic/20% binder fiber with a preferred average batt basis weight of 381 g/m$^2$ and average thickness of 32 mm in an uncompressed state.

2nd layer of 0.5 opsy nonwoven spunbond polyester scrim cloth from Hanes Converting Co.

Mattress Innersprings Layers, Consisting of:

1st layer over innersprings of cotton "shoddy pad"

2nd layer over innersprings of 0.375" non-FR polyurethane foam (L32S type)

The mattress quilt panel was sewn to the mattress border panel with 1.25" standard polyester mattress tape and Tex-45 Keviar thread.

The above constructed twin mattress was tested at Omega Point Laboratories (Elmendorf, Tex.) according to the concurrent California Test Bulletin 129. All flame ceased on the mattress after 6 minutes 10 seconds. The Peak Rate of Heat Release was 27.36 KW (maximum allowable rate of heat release is 100 KW), the Total Heat Release after 10 minutes was 5.37 MJ (maximum allowable in first 10 minutes is 25 MJ) and the Weight Loss in the first 10 minutes was 0.0 lbs (maximum allowable in first 10 minutes is 3 lbs). This test was considered a significant pass of CAL TB 129.

COMPARATIVE COMPOSITE ARTICLE EXAMPLE

A commercial twin mattress constructed with the following materials:

Mattress Quilt Panel, Sewn with Non-FR Quilting Thread, Consisting of:

Class A commercial mattress ticking fabric from Blumenthal Mills Inc. (Aristocrat "22" T-VBS 701)

1st layer under the ticking consisting of:

a nonwoven thermally bonded highloft flame barrier consisting of a fiber blend of:

55% melamine/30% polyester/15% binder fiber with a preferred average batt basis weight range of 305 g/m$^2$ and average thickness of 25 mm in an uncompressed state.

2$^{nd}$ layer under the ticking consisting of:

nonwoven thermally bonded highloft 100% polyester batt from Western Nonwovens, Inc.

with a preferred batt basis weight of 305 g/m$^2$ and thickness of 25 mm in an uncompressed state.

3$^{rd}$ layer under the ticking consisting of:

1" layer of non-flame retardant (FR) polyurethane foam from Carpenter Co. (R17S type)

4$^{th}$ layer of 1 opsy nonwoven spunbond polyester scrim cloth from Hanes Converting Co.

Mattress Border Panel, Sewn with Non-FR Quilting Thread, Consisting of:

Class A commercial mattress ticking fabric from Blumenthal Mills Inc. (Aristocrat "22" T-VBS 701)

1$^{st}$ layer under the ticking consisting of:

a nonwoven thermally bonded highloft flame barrier consisting of a fiber blend of:

55% melamine/30% polyester/15% binder fiber with a preferred average batt basis weight range of 305 g/m$^2$ and average thickness of 25 mm in an uncompressed state.

2$^{nd}$ layer of 0.5 opsy nonwoven spunbond polyester scrim cloth from Hanes Converting Co.

Mattress Innersprings Layers, Consisting of:

1$^{st}$ layer over innersprings of 100% polyester netting

2$^{nd}$ layer over innersprings of 0.375" non-FR polyurethane foam from Carpenter Co. (L32S type)

3$^{rd}$ layer over innersprings of 1.75" non-FR polyurethane foam from Carpenter Co. (S17S type)

The mattress quilt panel was sewn to the mattress border panel with 1.25" wide Firegard mattress tape (style 4368) Firegard thread and all mattress corners were protected by standard loose cotton fill.

The above constructed twin mattress was tested at Omega Point Laboratories (Elmendorf, Tex.) according to California Test Bulletin 129. The mattress failed the maximum heat release rate criteria test at 5 min 48 seconds and the test was terminated at 8 min 6 seconds. A maximum Peak Rate of Heat Release of 379.46 KW was obtained at 8 minutes 6 seconds (maximum allowable rate of heat release is 100 KW), the Total Heat Release during the first 8 min 6 seconds was 44.76 MJ (maximum allowable in First 10 minutes is 25 MJ) and the Weight Loss during the first 8 min 6 seconds was 2.2 lbs (maximum allowable in First 10 minutes is 3 lbs). This test was considered a failure of the stringent CAL TB 129 test because the maximum Peak Rate of Heat Release of 100 KW and Total Heat Release Rate were exceeded.

In an alternate embodiment of the present invention, there is featured a mixture of different category 1 inherently flame retardant fibers, such as a blend of melamine fibers (an example of an endothermic thermal degrading fiber) and inherently flame retardant cellulosic fibers (an example of an exothermic degrading fiber). As an example, an alternate embodiment of the invention preferably features a significant amount (e.g., greater than 20%) of a cellulosic fiber such as a viscose rayon based fiber with silica insulation such as a viscose rayon based fiber containing 33% aluminosilicate modified silica, $S_iO_2+Al_2O_3$. A suitable version of this type of fiber in raw form is made by Säteri Oy located in Valkeakoske, Finland. The fiber is commonly referred to by its trade name Visil® fiber. A preferred Visil® fiber is Visil 33 AP available in dtex values ranging between 1.7 and 8.0, with Visil 33 AP (with a dtex of 5.0) being one preferred type which is within the noted range and also considered suited for uses under the present invention.

In one embodiment of the invention the blend comprises a category 1 combination of the fibers such as melamine fiber (e.g., 10 to 50% of melamine fiber) and a significant amount (e.g., 10 to 50%) of viscose based rayon fiber. Preferably the percentage value of the melamine and viscose based rayon are within ±15% to 25% of each other, (i.e., either the endothermic melamine fibers being greater in weight relative to the viscose based rayon (e.g., exothermic fibers), vice versa, or equal in weight). As one example of a suitable category 1 combination blend, Visil® fibers having the above noted aluminosilicate modified silica is provided in an amount of 30% (±10) together with 30% (±10) Basofil® melamine fiber and the category 1 combination is blended or otherwise utilized with category 2 halogenated monomers fibers such as modacrylic fibers as referenced in the current examples in the application. An amount of, for example, 10-40% (e.g., 20%) for the category 2 material is well suited for the above noted mix combination for category 1. The aforementioned mix also further preferably includes 4-denier thermal binder in an amount such as 20% (±5).

Indicative bench scale tests using a CAL TB 129 burner revealed this new blend was effective in resisting burn-through. This introduces the potential for using lighter weights for the same relative performance criteria, thus providing the potential of reducing the overall cost of manufacturing an article. A composite article example utilizing the above category 1 mixture features is provided below relative to a mattress (without foundation) tested according to California Test Bulletin 129.

COMPOSITE ARTICLE EXAMPLE III

A commercial twin mattress constructed with the following materials:

Mattress Quilt Panel, Sewn with Non-FR Quilting Thread, Consisting of:

Residential polyester/cotton mattress ticking fabric

1$^{st}$ layer under the ticking consisting of:

nonwoven thermally bonded highloft flame barrier consisting of a fiber blend including:

25% melamine/33% Visil/20% modacrylic/22% binder fiber with a preferred average batt basis weight of 153 g/m$^2$ and average thickness of 15 nm in an uncompressed state.

2$^{nd}$ layer under the ticking consisting of:

1" layer of non-flame retardant (FR) polyurethane foam

3$^{rd}$ layer of 1 opsy nonwoven spunbond polyester scrim cloth

Mattress Border Panel, Sewn with Non-FR Quilting Thread, Consisting of:

Residential polyester/cotton mattress ticking fabric

1$^{st}$ layer under the ticking consisting of:

nonwoven thermally bonded highloft flame barrier consisting of a fiber blend including:

25% melamine/33% Visil/20% modacrylic/22% binder fiber with a preferred average batt basis weight of 153 g/m$^2$ and average thickness of 15 mm in an uncompressed state.

2$^{nd}$ layer of 0.5 opsy nonwoven spunbond polyester scrim cloth

Mattress Innersprings Layers, Consisting of:

1$^{st}$ layer over innersprings of 100% densified polyester highloft

2$^{nd}$ layer over innersprings of 1" non-FR polyurethane foam

The mattress quilt panel was sewn to the mattress border panel with decorative polyester mattress tape and Kevlar thread.

The above constructed twin mattress was tested at Omega Point Laboratories (Elmendorf, Tex.) according to California Test Bulletin 129. All flame ceased on the mattress after 53 minutes 06 seconds. The Peak Rate of Heat Release was 36.7 KW (maximum allowable rate of heat release is 100 KW), the Total Heat Release after 10 minutes was 7.8 MJ (maximum allowable in first 10 minutes is 25 MJ) and the Weight Loss in the first 10 minutes was 0.7 lbs (maximum allowable in first 10 minutes is 3 lbs). This test was considered a pass of CAL TB 129.

While the invention has been described in detail with reference to specific embodiments thereof, it will be apparent to one skilled in the art that various changes and modifications can be made, and equivalents employed, without departing from the scope of the appended claims.

What is claimed is:

1. A nonwoven highloft flame barrier for use in mattresses, upholstered furniture, fiber-filled bed clothing, transportation seating and the like comprising a blend of the following:

(a) 10-85% by weight of inherently flame retardant fibers selected from the group consisting of melamines, meta-aramids, para-aramids, polybenzimidazole, polyimides, polyamideimides, partially oxidized polyacrylonitriles, novoloids, poly(p-phenylene benzobisoxazoles), poly(p-phenylene benzothiazoles), polyphenylene sulfides, flame retardant viscose rayons, polyetheretherketones, polyketones, polyetherimides, and combinations thereof;

(b) 10-85% by weight modacrylic fibers;

(c) the combination of inherently flame retardant fibers and modacrylic fibers having a combined weight of at least 40% of the blend;

(d) up to 30% of low melt binder fibers; and (e) the fibers being blended and processed by non-mechanical bonding in such a manner as to produce a blend having a greater volume of air than fiber and a bulk density in the range of 5-50 kg/m$^3$.

2. The flame barrier as recited in claim 1 wherein said inherently flame retardant fibers include melamine fibers in a mix with at least one additional type of inherently flame retardant fibers having a different thermal resistance characteristic.

3. The flame barrier as recited in claim 1 wherein said flame barrier is comprised of a plurality of flame barrier layers.

4. The flame barrier as recited in claim 3 wherein a first of said layers includes said inherently flame retardant fibers and modacrylic fibers and a second of said layers includes inherently flame retardant fibers but is free of modacrylic fibers.

5. The flame barrier as recited in claim 1 wherein the inherently flame retardant fibers comprises endothermic thermally decomposing inherently flame retardant fibers.

6. The flame barrier as recited in claim 5 wherein the inherently flame retardant fibers further comprise exothermic thermally decomposing inherently flame retardant fibers.

7. The flame barrier as recited in claim 1 wherein said inherently flame retardant fibers includes a mixture of melamine and viscose rayon fibers.

8. The flame barrier as recited in claim 7 wherein the percentage by weight of each of said inherently flame retardant fibers is 30+15% relative to the total flame barrier weight.

9. The flame barrier as recited in claim 1 further comprising up to 40% of non-flame retardant fiber.

10. The flame barrier as recited in claim 1 further comprising non-flame retardant fibers and wherein said non-flame retardant fibers are present in a percentage by weight amount of 1 to 60%.

11. The flame barrier as recited in claim 10 wherein said non-flame retardant fibers are non-natural fibers selected from the group consisting of nylons, polyesters, polyolefins, acrylics, cellulose, acetates, polylactides and combinations thereof and representing a percentage by weight of 1 to 30% of the flame barrier.

12. The flame barrier of claim 1 wherein said inherently flame retardant fibers include fire retardant cellulosic fibers.

13. A product upholstered or manufactured with the non-woven highloft flame barrier of claim 1.

14. The product of claim 13 wherein said product is a composite article comprising the flame barrier and at least one other article component.

15. The product of claim 14 wherein said product is capable of passing at least one of the following stringent open flame test protocols: California Test Bulletin 133, California Test Bulletin 129, and British Standard 5852 with a crib 5 flame source.

16. The product of claim 14 wherein said at least one other article component includes a foam layer.

17. The product of claim 14 wherein said product is a mattress component.

18. The product of claim 14 wherein said at least one other article component is in contact with said flame barrier and is less flame resistant or flame retardant than said flame barrier.

19. The product of claim 14 wherein said other article includes a fabric covering.

20. The product of claim 14 wherein said product is free of a fire resistant coating in use.

21. The product of claim 13 wherein said product is capable of passing at least one of the following stringent open flame test protocols: California Test Bulletin 133, California Test Bulletin 129, and British Standard 5852 with a crib 5 flame source.

22. The product of claim 13 wherein said flame barrier is multi-layered.

23. The product of claim 22 wherein two of said layers includes different percentages by weight of inherently flame retardant fibers and inodacrylic fibers.

24. The product of claim 13, wherein the product comprises an outer covering fabric layer, which is free of a fire resistant coating and positioned in contact with said flame barrier.

25. The flame barrier as recited in claim 1 wherein a majority of inherently flame retardant fibers are melamine.

26. The flame barrier of claim 1 further comprising natural fibers.

27. The flame barrier as recited in claim 26 wherein said natural fibers are selected from the group consisting of cotton, wool, silk, mohair, cashmere, and combinations thereof.

28. The flame barrier of claim 1 wherein the inherently flame retardant fibers include viscose rayon fibers containing silica or aluminosilicate modified silica.

29. The flame barrier of claim 1 wherein said inherently flame retardant fibers include a combination of m-aramid fibers and flame retardant viscose rayon fibers.

30. The flame barrier of claim 1 wherein said inherently flame retardant fibers include a combination of m-aramid fibers and flame retardant viscose rayon fibers containing silica or aluminosilicate modified silica.

31. The flame barrier of claim 1 wherein said inherently flame retardant fibers include a combination of p-aramid fibers and flame retardant viscose rayon fibers.

32. The flame barrier of claim 1 wherein said inherently flame retardant fibers include a combination of p-aramid fibers and flame retardant viscose rayon fibers containing silica or aluminosilicate modified silica.

33. The flame barrier of claim 1 wherein said inherently flame retardant fibers include a combination of polyamide-imide fibers and flame retardant viscose rayon fibers.

34. The flame barrier of claim 1 wherein said inherently flame retardant fibers include a combination of polyamide-imide fibers and flame retardant viscose rayon fibers containing silica or aluminosilicate modified silica.

35. The flame barrier of claim 1 wherein said inherently flame retardant fibers include a combination of polyphenylene sulfide fibers and flame retardant viscose rayon fibers.

36. The flame barrier of claim 1 wherein said inherently flame retardant fibers include a combination of polyphenylene sulfide fibers and flame retardant viscose rayon fibers containing silica or aluminosilicate modified silica.

37. The flame barrier of claim 1 wherein said inherently flame retardant fibers include a combination of novoloid fibers and flame retardant viscose rayon fibers.

38. The flame barrier of claim 1 wherein said inherently flame retardant fibers include a combination of novoloid fibers and flame retardant viscose rayon fibers containing silica or aluminosilicate modified silica.

39. The flame barrier of claim 1 wherein said inherently flame retardant fibers include a combination of polyimide fibers and flame retardant viscose rayon fibers.

40. The flame barrier of claim 1 wherein said inherently flame retardant fibers include a combination of polyimide fibers and flame retardant viscose rayon fibers containing silica or aluminosilicate modified silica.

41. The flame barrier of claim 1 wherein said inherently flame retardant fibers include a combination of polyetherimide fibers and flame retardant viscose rayon fibers.

42. The flame barrier of claim 1 wherein said inherently flame retardant fibers include a combination of polyetherimide fibers and flame retardant viscose rayon fibers containing silica or aluminosilicate modified silica.

43. The flame barrier of claim 1 wherein the modacrylic fibers further include antimony oxide.

44. The flame barrier of claim 1 wherein the bulk density is 6-30 kg/m$^3$.

45. The flame barrier of claim 1 formed by a non-compressive thermobonding process.

46. A nonwoven highloft flame barrier for use in mattresses, upholstered furniture, fiber-filled bed clothing, transportation seating and the like comprising a blend of the following:

(a) 10-85% by weight of inherently flame retardant fibers selected from the group consisting of melamines, meta-aramids, para-aramids, polybenzimidazole, polyimides, polyamideimides, partially oxidized polyacrylonitriles, novoloids, poly(p-phenylene benzobisoxazoles), poly(p-phenylene benzothiazoles), polyphenylene sulfides, flame retardant viscose rayons, polyetheretherketones, polyketones, polyetherimides, and combinations thereof;

(b) 10-85% by weight modacrylic fibers;

(c) the combination of inherently flame retardant fibers and modacrylic fibers having a combined weight of at least 40% of the blend;

(d) a halogenated binder resin; and (e) the fibers being blended and processed by non-mechanical bonding in such a manner as to produce a blend having a greater volume of air than fiber and a bulk density in the range of 5-50 kg/m$^3$.

47. The flame barrier of claim 46 further comprising non-flame retardant fibers present in a percentage by weight amount of 1 to 60%.

48. The flame barrier of claim 47 wherein the non-flame retardant fibers are non-natural fibers selected from the group consisting of nylons, polyesters, polyolefins, acrylics, cellulose, acetates, polylactides and combinations thereof and representing a percentage by weight of 1 to 30% of the flame barrier.

49. A nonwoven highloft flame barrier for use in mattresses, upholstered furniture, fiber-filled bed clothing, transportation seating and the like comprising a blend of the following:

(a) 10-85% by weight of inherently flame retardant fibers selected from the group consisting of melamines, meta-aramids, para-aramids, polybenzimidazole, polyimides, polyamideimides, partially oxidized polyacrylonitriles, novoloids, poly(p-phenylene benzobisoxazoles), poly(p-phenylene benzothiazoles), polyphenylene sulfides, flame retardant viscose rayons, polyetheretherketones, polyketones, polyetherimides, and combinations thereof;

(b) 10-85% by weight modacrylic fibers;

(c) the combination of inherently flame retardant fibers and modacrylic fibers having a combined weight of at least 40% of the blend;

(d) up to 40% of natural fiber;

(e) up to 40% of non-flame retardant polymeric fibers; and (f) the inherently flame retardant fibers and modacrylic fibers being blended in such a manner as to produce a blend having a greater volume of air than fiber and bulk density in the range 5-50 kg/m$^3$.

50. The flame barrier of claim 49 wherein the inherently flame retardant fibers represent 20 to 70% by weight of said fiber blend and the modacrylic fibers represent 20 to 70% by weight of said fiber blend.

51. The flame barrier of claim 50 wherein said inherently flame retardant fibers provide 30 to 60% by weight of said fiber blend and wherein the modacrylic fibers provide 30 to 60% by weight of said fiber blend.

52. The flame barrier of claim 49 further including low melt binder fibers providing up to 30% by weight of the fiber blend.

53. The flame barrier of claim 49 wherein said inherently flame retardant fibers include a mix of exothermic and endothermic inherently flame retardant fibers.

54. The flame barrier of claim 49 wherein said blend further includes a cellulosic fiber.

55. The flame barrier of claim 49 wherein said blend further includes a viscose rayon based fiber with silica.

56. The flame barrier of claim 49 wherein said viscose rayon based fiber contains aluminumsilicate modified silica.

* * * * *